US006456314B1

(12) United States Patent
Masuda

(10) Patent No.: US 6,456,314 B1
(45) Date of Patent: Sep. 24, 2002

(54) OPTICAL PRINTING HEAD AND IMAGE FORMING APPARATUS USING IT

(75) Inventor: Koji Masuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/709,414

(22) Filed: Nov. 13, 2000

(30) Foreign Application Priority Data

Nov. 25, 1999 (JP) ..... 11-334329

(51) Int. Cl.[7] ..... B41J 27/00; B41J 15/14
(52) U.S. Cl. ..... 347/244; 347/258
(58) Field of Search ..... 347/241, 244, 347/256, 258; 257/88; 359/622, 626; 355/52

(56) References Cited

U.S. PATENT DOCUMENTS 4,678,321 A * 7/1987 Inokuchi ..... 355/52
4,696,545 A * 9/1987 Lama et al. ..... 359/626
5,606,181 A * 2/1997 Sakuma et al. ..... 257/88
5,768,023 A * 6/1998 Sawaki et al. ..... 359/622

* cited by examiner

*Primary Examiner*—Hai Pham
(74) *Attorney, Agent, or Firm*—Oblon, Spivak, McClelland, Maier & Neustadt, P.C.

(57) ABSTRACT

An optical printing head includes a light-emitting component array having a plurality of light-emitting components arranged therein, and an imaging component array having a plurality of imaging components arranged therein each for imaging from a light flux from a respective light-emitting component of the light-emitting component array to a beam spot on an image carrying body surface. In a configuration relationship between the light-emitting component array, imaging component array and image carrying body surface, a focal length of the imaging components is slightly larger than the focal length of imaging components in a condition in which a unity-magnification relationship is satisfied.

14 Claims, 7 Drawing Sheets

OPTICAL PRINTING HEAD AND IMAGE FORMING APPARATUS USING IT

BACKGROUND OF THE INVENTION

1. Field of the Invention

The present invention generally relates to an optical printing head used in a digital writing optical system in a solid scanning writing system, and to an image forming apparatus using the optical printing head, and, can be applied to a digital copier, a printer, a digital facsimile machine and so forth.

2. Description of the Related Art

Recently, as digital outputting apparatuses such as a digital copier, a printer, a digital facsimile machine and so forth are miniaturized, miniaturization of digital writing devices used therein is demanded.

Currently, digital writing systems can be roughly classified into two types.

One thereof is an optical scanning system in which a light flux emitted from a light source such as a semiconductor laser is deflected by an optical deflector, and is used for forming a beam spot by an optical scanning and imaging lens.

The other one is a solid scanning system in which light fluxes emitted from light-emitting component array light source such as an LED array are used for forming beam spots by an imaging component array.

In the optical scanning system, the length of light path is large because an optical deflector deflects a light flux.

In contrast to this, in the solid scanning system, it is possible to shorten the length of light path remarkably. Accordingly, it is possible to miniaturize the entirety of the apparatus, and, also, this system does not need a mechanical driving component such as an optical deflector.

As unity-magnification imaging components used in the solid scanning system, a roof prism lens array and a roof mirror lens array have been proposed.

The roof prism lens array is an imaging component array in which a plurality of roof prism lenses, each having an entrance surface, an exit surface and a prism surface formed integrally therein, are arranged.

The roof mirror lens array is an imaging component array including a lens array in which a plurality of lenses each having an entrance surface and an exit surface are arranged and a roof mirror array in which a plurality of roof mirrors each having two reflective surfaces at right angles to each other are arranged.

In the related art, an imaging component array such as the above-mentioned roof prism lens array or roof mirror lens array is set so that the focal length thereof has a unity-magnification relationship with respect to a configuration relationship between a light-emitting component array, the imaging component array and an image carrying body surface, and, is called a unity-magnification imaging component array forming an erecting system in an arranging direction.

'The unity-magnification relationship' is a relationship such that the imaging magnification (lateral magnification) in the optical system including the position of the object point at which the light-emitting component array is disposed, the imaging (image-forming) component array and the position of the image point at which the image carrying body surface is disposed is 1.

However, it has been confirmed that, in an imaging component array in which an entrance surface and an exit surface of the above-mentioned roof prism lens array or the entrance surface and exit surface of the lens array of the above-mentioned roof mirror lens array are spherical surfaces, when setting is made such that the focal length of the imaging component array has a unity-magnification relationship with respect to a configuration relationship between a light-emitting component array, the imaging component array and an image carrying body surface, the defocus position (position of the beam waist) at which the diameter of the beam spot becomes minimum in the depth curve of the diameter of the beam spot in the direction perpendicular to the arranging direction of each array is away from the image carrying body surface.

Further, in order to enlarge an allowance of an assembling error at a time an optical printing head is held in an image forming apparatus and a manufacturing error of an imaging component array, it is preferable to enlarge a defocus range in which the diameter of beam spot can be allowed for the practical use, that is, a so-called allowance of focal depth.

SUMMARY OF THE INVENTION

The present invention has been devised in order to solve the above-mentioned problems, and an object of the present invention is to provide an optical printing head and an image forming apparatus employing the optical printing head by which it is possible to make the position of the beam waist in the direction perpendicular to the array arranging direction be on or in the proximity of the image carrying body surface, and, also, to enlarge the allowance of focal depth.

An optical printing head according to the present invention comprises:

a light-emitting component array having a plurality of light-emitting components arranged therein; and an imaging component array having a plurality of imaging components arranged therein each for imaging from a light flux from a respective light-emitting component of the light-emitting component array to a beam spot on an image carrying body surface, wherein, in a configuration relationship between the light-emitting component array, imaging component array and image carrying body surface, a focal length of the imaging components is slightly larger than the focal length of the imaging components obtained in a condition in which a unity-magnification relationship is satisfied.

Thereby, it is possible to locate the position of the beam waist in the arranging perpendicular direction on or in the proximity of the image carrying body surface, and, also, to enlarge the allowance of focal depth.

It is preferable that $$1.005 \leqq f/f' \leqq 1.025$$

where:

f denotes the focal length of the imaging components; and f' denotes the focal length of the imaging components obtained in the condition in which the unity-magnification relationship is satisfied.

Thereby, it is possible to locate the position of the beam waist in the arranging perpendicular direction on or in the proximity of the image carrying body surface, and, also, to enlarge the allowance of focal depth, more effectively.

It is preferable that the focal length is made slightly longer as a result of radiuses of curvatures of surfaces having power of the imaging components being changed from radiuses of curvatures of surfaces having power of the imaging components obtained in the condition in which the unity-magnification relationship is satisfied.

Thereby, it is possible to avoid change of the optical layout and to eliminate influence on manufacturing method and costs of the imaging components.

It is preferable that an arranging pitch of the imaging component array is equal to or shorter than 1 mm.

Thereby, it is possible to prevent vertical strips in a resulting image from being remarkable, and to reduce the aberration of the imaging components to a smaller value.

It is preferable that the imaging component array comprises a roof prism lens array in which entrance surfaces are equal to exit surfaces in radius of curvature in absolute value.

Thereby, it is possible to easily reduce the component costs.

It is preferable that $$1.005 \leqq R/R' \leqq R\ 1.03$$

where:

R denotes the absolute value of the radiuses of curvatures of the entrance surfaces and exit surfaces of the imaging component array; and R' denotes an absolute value of radiuses of curvatures of entrance surfaces and exit surfaces of the imaging component array obtained in the condition in which the unity-magnification relationship is satisfied.

Thereby, it is possible to locate the position of the beam waist in the arranging perpendicular direction on or in the proximity of the image carrying body surface, and, also, to enlarge the allowance of focal depth, more effectively.

It is preferable that a ratio of an aperture diameter in an arranging perpendicular direction to an aperture diameter in an arranging direction is larger than 1.

Thereby, it is possible to locate the position the beam waist in the arranging perpendicular direction on or in the proximity of the image carrying body surface more effectively, and, also, to provide a brighter imaging optical system.

An image forming apparatus according to the present invention employs any of the above-mentioned optical printing heads as an exposure unit.

By using this image forming apparatus, it is possible to obtain a stable diameter of beam spot, and, to obtain a satisfactory image in which vertical stripes are not likely to be remarkable.

Other objects and further features of the present invention will become more apparent from the following detailed description when read in conjunction with the accompanying drawings.

BRIEF DESCRIPTION OF THE DRAWINGS

FIG. 2B showing a section in a direction (arranging perpendicular direction) perpendicular to the direction in which the array is arranged);

DETAILED DESCRIPTION OF THE PREFERRED EMBODIMENTS

An optical printing head and an image forming apparatus employing the optical printing head according to the present invention will now be described with reference to the figures.

Figure 1:
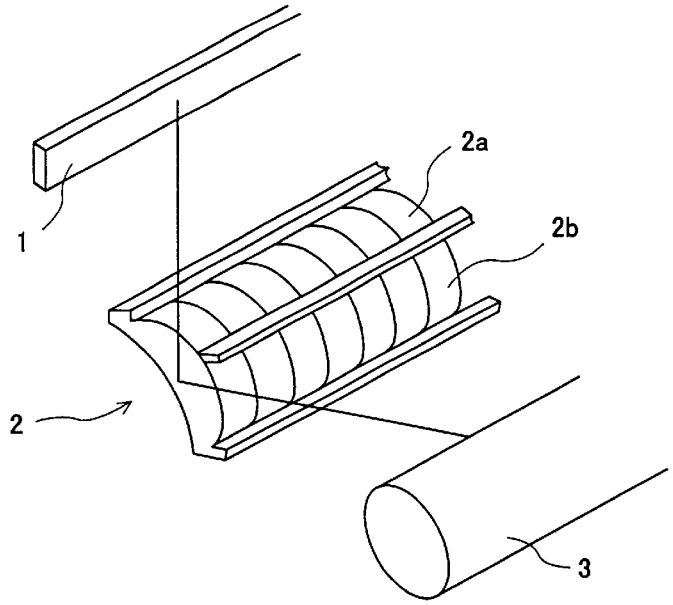
FIG. 1 shows a perspective view of an optical printing head in each of first and second embodiments of the present invention.
Figures 2A, 2B:
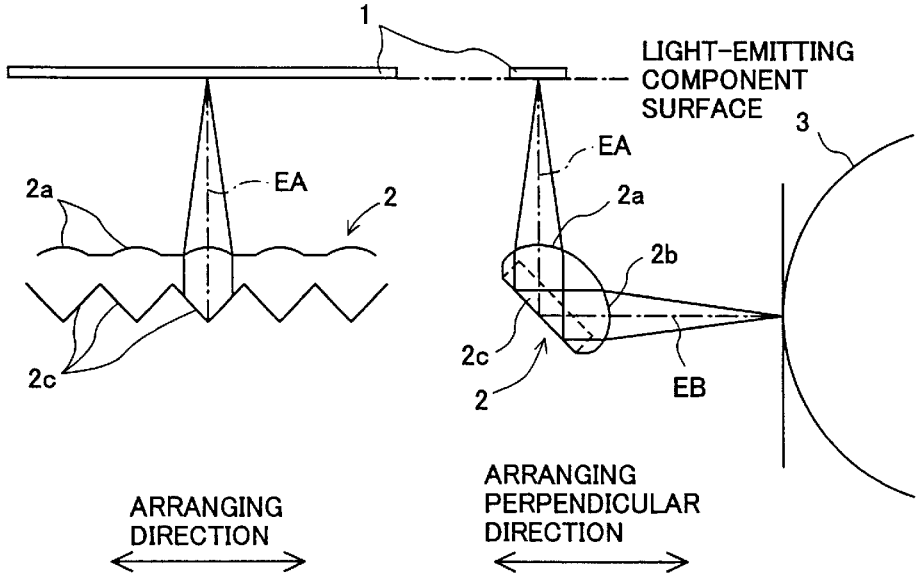
FIGS. 2A and 2B show a roof prism lens array which can be employed in the optical printing head shown in FIG. 1 (FIG. 2A showing a section in a direction (arranging direction) in which the array is arranged.

FIGS. 1, 2A and 2B show an imaging (imagery or image-formation) component array of an optical printing head in each of first and second embodiments of the present invention and an above-mentioned light-emitting component array.

The light-emitting component array 1 is a surface-light-emitting-type light-emitting component array which emits light in a direction perpendicular to a substrate thereof, and has many surface-light-emitting-type light-emitting components (for example, LEDs) arranged in a direction in which the imaging components of the imaging component array 2 are arranged.

However, the present invention is not limited to employing such a surface-light-emitting-type light-emitting components, and an end-surface-light-emitting-type light-emitting components may also be employed instead.

The imaging component array 2 shown in FIGS. 1, 2A and 2B is a roof prism lens array (RPLA), for example.

The roof prism lens array 2 is used for imaging as (forming images of) beam spots on an image carrying body surface of an image carrying body 3 from light fluxes emitted from respective light-emitting components of the light-emitting component array 1.

The roof prism lens array 2 is an imaging component array including a plurality of roof prism lenses arranged, each having an entrance surface 2*a* located on the entrance side, that is, the side of the light-emitting component array 1, an exit surface 2*b* located on the exit side, that is, the side of the image carrying body surface of the image carrying body 3, and a prism surface 2*c* for directing a light flux from the entrance surface 2*a* to the exit surface 2*b*. The entrance surface 2*a,* exit surface 2*b* and prism surface 2*c* are integrally formed in each roof prism lens.

Further, the roof prism lens array 2 acts as an erecting system in the direction in which the roof prism lenses are arranged such that a light-emitting pattern in the direction in which the light-emitting components of the light-emitting component array 1 are arranged can be formed on the image carrying body surface of the image carrying body 3 as it is.

It is noted that FIG. 2A shows a section of the roof prism lens array 2 in the direction (arranging direction) in which the imaging components are arranged, and FIG. 2B shows a section of the roof prism lens array 2 in the direction (arranging perpendicular direction) perpendicular to the direction in which the imaging components are arranged.

A light flux emitted from one point on the light-emitting component surface of the light-emitting component array 1 is incident on the entrance surface 2*a* of the imaging component array 2, is reflected by a pair of total reflective surfaces forming the prism surface 2*c* in sequence, exits from the exit surface 2*b,* and reaches the image carrying body surface of the image carrying body 3.

The pair of total reflective surfaces forming the prism surface 2*c* have no imaging function, and are inclined by 45° from the entrance light axis EA. Further, the entrance light axis EA and the exit light axis EB meet approximately at right angles.

By the imaging function of the entrance surface 2*a* and exit surface 2*b,* an image at one point on the light-emitting component surface is formed on the corresponding one point on the image carrying body surface of the image carrying body 3.

Thus, images on the surfaces of respective ones of the many light-emitting components arranged in the light-emitting component array 1 are formed like a line on the image carrying body surface of the image carrying body 3.

The direction of this line is a main scanning direction, and, it is possible to form an image on the image carrying body surface of the image carrying body 3 by controlling ON/OFF of the many light-emitting components arranged in the light-emitting component array 1, with rotation of the image carrying body 3 in a sub-scanning direction.

Features of the present invention will now be described.

Figure 3:
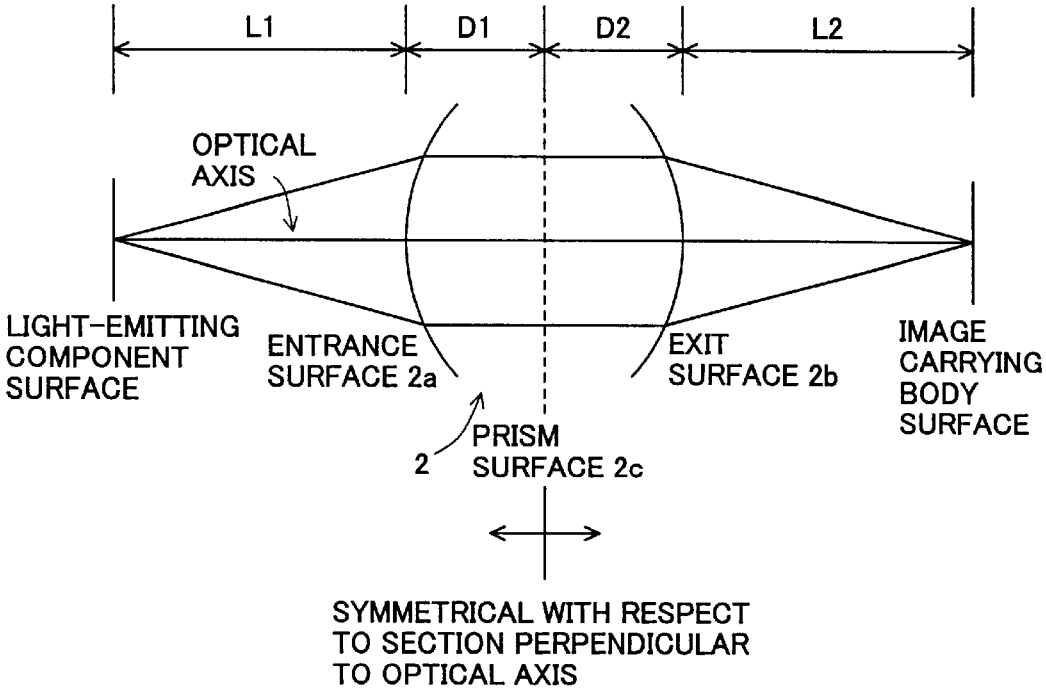
FIG. 3 simply shows an optical layout of the optical printing head shown in FIG. 1.

As shown in FIG. 3, the optical layout is symmetrical with respect to a section perpendicular to the opitcal axis at the center of the optical axis extending from the light-emitting component array 1 to the image carrying body surface of the image carrying body 3.

Further, in the configuration relationship between the light-emitting component array 1, roof prism lens array 2 and image carrying body surface of the image carrying body 3, the focal length of the imaging components of the roof prism lens array 2 is set slightly larger than the focal length of the imaging components of the roof prism lens array 2 obtained in a condition in which a unity-magnification relationship is satisfied.

As described above, 'the unity-magnification relationship' is a relationship such that the imaging magnification (lateral magnification) in the optical system including the position of the object point at which the light-emitting component array 1 is disposed, the imaging (image-forming) component array 2 and the position of the image point at which the image carrying body surface of the image carrying body 3 is disposed is 1, hereinafter.

This setting is made by modifying the radiuses of curvatures of the surfaces having powers, that is, the entrance surfaces 2*a* and exit surfaces 2*b* of the imaging components of the roof prism lens array 2 from the radiuses of curvatures of the entrance surfaces 2*a* and exit surfaces 2*b* of the imaging components of the roof prism lens array 2 obtained in the condition in which the unity-magnification relationship is satisfied.

This point will now be described in details through the two embodiments of the present invention.

In FIG. 3, L1 denotes the distance from the light-emitting component array 1 to the entrance surfaces 2*a* of the roof prism lens array 2, D1 denotes the distance from the entrance surfaces 2*a* of the roof prism lens array 2 to the center of the roof prism lens array 2 on the optical axis extending from the light-emitting component array 1 to the image carrying body surface of the image carrying body 3, D2 denotes the distance from the center of the roof prism lens array 2 on the optical axis extending from the light-emitting component array 1 to the image carrying body surface of the image carrying body 3 to the exit surfaces 2*b* of the roof prism lens array 2, and L2 denotes the distance from the exit surfaces 2*b* of the roof prism lens array 2 to the image carrying body surface of the image carrying body 3.

In this configuration, as mentioned above, the optical layout is symmetrical with respect to the section perpendicular to the opitcal axis at the center of the optical axis extending from the light-emitting component array 1 to the image carrying body surface of the image carrying body 3. Accordingly, L1=L2, and D1=D2.

Further, N denotes the refractive index of the imaging components of the roof prism lens array 2, R1 and R2 denote the radiuses of curvatures of the entrance surfaces 2*a* and exit surfaces 2*b* of the roof prism lens array 2, respectively.

The first embodiment of the present invention will now be described.

The first embodiment has the above-described configuration shown in FIGS. 1, 2A, 2B and 3.

The optical data of the first embodiment is as follows:

N1=1.525;

L1=L2=6.0 (mm);

D1=D2=1.2 (mm);

R1=3.20356 (mm); and

R2=−3.20356 (mm).

The focal length f of the imaging components of the roof prism lens array 2 is as follows:

$$1/f=(N-1)\times\{1/R1-1/R2+(N-1)/N\times D/R1/R2)\},$$

where $$D=D1+D2 \quad (1)$$

Then, f=3.5027 (mm).

The second embodiment of the present invention will now be described.

The second embodiment also has the above-described configuration shown in FIGS. 1, 2A, 2B and 3.

The optical data of the second embodiment is as follows:

N1=1.525;

L1=L2=7.0 (mm);

D1=D2=0.7 (mm);

R1=3.71394 (mm); and

R2=−3.71394 (mm).

The focal length f of the imaging components of the roof prism lens array 2 is also obtained by the above-mentioned equation (1).

Then, f=3.7825 (mm).

As a comparison example 1 to the above-mentioned first embodiment, the optical data in the condition in which, in the configuration relationship between the light-emitting component array 1, roof prism lens array 2 and image carrying body surface, the focal length of the imaging components of the roof prism lens array 2 satisfies the unity-magnification relationship will now be described.

N1=1.525;

L1=L2=6.0 (mm);

D1=D2=1.2 (mm);

R1'=3.15 (mm); and

R2'=−3.15 (mm).

Further, in the comparison example 1, the focal length f' of the imaging components of the roof prism lens array 2 is also obtained by the above-mentioned equation (1).

Then, f'=3.4528 (mm).

As a comparison example 2 to the above-mentioned second embodiment, the optical data in the condition in which, in the configuration relationship between the light-emitting component array 1, roof prism lens array 2 and image carrying body surface, the focal length of the imaging components of the roof prism lens array 2 satisfies the unity-magnification relationship will now be described.

N1=1.525;

L1=L2=7.0 (mm);

D1=D2=0.7 (mm);

R1'=3.675 (mm); and

R2'=−3.675 (mm).

Further, in the comparison example 2, the focal length f' of the imaging components of the roof prism lens array 2 is also obtained by the above-mentioned equation (1).

Then, f'=3.7456 (mm).

When the focal length f of the above-mentioned first embodiment is compared with the focal length f' of the comparison example 1, and the focal length f of the above-mentioned second embodiment is compared with the focal length f' of the comparison example 2, f>f' in each comparison.

Accordingly, it can be seen that, in the configuration relationship between the light-emitting component array 1, roof prism lens array 2 and image carrying body surface of the image carrying body 3, the focal length f of the roof prism lens array 2 is set slightly larger than the focal length f' of the roof prism lens array 2 obtained in the condition in which the unity-magnification relationship is satisfied.

By setting the focal length f of the roof prism lens array 2 slightly larger than the focal length f' of the roof prism lens array 2 obtained in the condition in which the unity-magnification relationship is satisfied in the configuration relationship between the light-emitting component array 1, roof prism lens array 2 and image carrying body surface of the image carrying body 3, it is possible to make the position of the beam waist in the direction (arranging perpendicular direction) perpendicular to the arranging direction (direction in which the imaging components of the roof prism lens array 2 are arranged) be located on or in the proximity of the image carrying body surface, and to enlarge the allowance of focal depth.

Further, by setting the focal length f of the imaging components of the roof prism lens array 2 slightly larger than the focal length f' of the imaging components of the roof prism lens array 2 obtained in the condition in which the unity-magnification relationship is satisfied in the configuration relationship between the light-emitting component array 1, roof prism lens array 2 and image carrying body surface of the image carrying body 3 such that the following inequality (2) is satisfied, $$1.005 \leqq f/f' \leqq 1.025 \quad (2),$$

it is possible to make the position of the beam waist in the arranging perpendicular direction be located on or in the proximity of the image carrying body surface, and to enlarge the allowance of focal depth, further effectively.

The ratio f/f' of the focal length f of the first embodiment to the focal length f' of the comparison example 1 is such that f/f'=1.014, and satisfies the above-mentioned inequality (2). Similarly, the ratio f/f' of the focal length f of the second embodiment to the focal length f' of the comparison example 2 is such that f/f'=1.010, and also satisfies the above-mentioned inequality (2).

Further, setting may be made such that the following inequality is satisfied:

$$1.005 \leqq R/R' \leqq 1.03 \quad (3),$$

where R denotes the absolute value of the radiuses of curvatures of the entrance surfaces 2*a* and exit surfaces 2*b* of the roof prism lens array 2 in the condition in which, in the configuration relationship between the light-emitting component array 1, roof prism lens array 2 and image carrying body surface of the image carrying body 3, the focal length of the imaging components of the roof prism lens array 2 is slightly larger than the focal length of the imaging components of the roof prism lens array 2 obtained in the condition in which the unity-magnification relationship is satisfied, and R' denotes the absolute value of the radiuses of curvatures of the entrance surfaces 2*a* and exit surfaces 2*b* of the roof prism lens array 2 obtained in the condition in which the unity-magnification relationship is satisfied.

Also by this setting, it is possible to make the position of the beam waist in the arranging perpendicular direction be located on or in the proximity of the image carrying body surface, and to enlarge the allowance of focal depth, further effectively.

The ratio R/R' of the absolute value R of the radiuses of curvatures R1, R2 of the entrance surfaces 2*a* and exit surfaces 2*b* of the first embodiment to the absolute value R' of the radiuses of curvatures R1', R2' of the entrance surfaces 2*a* and exit surfaces 2*b* of the comparison example 1 is such that R/R'=1.017, and satisfies the above-mentioned inequality (3). Similarly, the ratio R/R' of the absolute value R of the radiuses of curvatures R1, R2 of the entrance surfaces 2*a* and exit surfaces 2*b* of the second embodiment to the absolute value R1 of the radiuses of curvatures R1', R2' of the entrance surfaces 2*a* and exit surfaces 2*b* of the comparison example 2 is such that R/R'=1.011, and also satisfies the above-mentioned inequality (3).

Further, by employing, as an imaging component array, the roof prism lens array 2 in which the radiuses of curvatures of the entrance surfaces 2*a* are equal to the radiuses of curvatures of exit surfaces 2*b* in absolute value as in those embodiments, it is possible to easily achieve reduction of costs of the parts/components.

Further, as a result of making the focal length of the imaging components of the roof prism lens array 2 be slightly larger than the focal length of the imaging components of the roof prism lens array 2 obtained in the condition in which the unity-magnification relationship is satisfied in the configuration relationship between the light-emitting component array 1, roof prism lens array 2 and image carrying body surface of the image carrying body 3, by modifying the radiuses of curvatures of the entrance surfaces 2*a* and exit surfaces 2*b* of the roof prism lens array 2 from the radiuses of curvatures of the entrance surfaces 2*a* and exit surfaces 2*b* of the roof prism lens array 2 obtained in the condition in which the unity-magnification relationship is satisfied, it is possible to eliminate necessity of change of the optical layout, and influence on the manufacturing method and cost of the imaging components.

As methods of modifying the above-mentioned focal length, methods in which the thickness of the imaging components is changed, the distance between the imaging components is changed and the material (refractive index) of the imaging components is changed can be considered. However, in the former two methods, the optical layout should be changed. In the last method, the manufacturing method and cost of the imaging components should be changed. Accordingly, in comparison thereto, it is preferable to modify the above-mentioned focal length by changing the radiuses of curvatures which can be freely dealt with as design parameters.

Further, by making the arranging pitch of the imaging components of the roof prism lens array 2 be equal to or smaller than 1 mm, it is possible to prevent vertical stripes from being remarkable in a resulting image, and, also, to reduce aberrations of the imaging components to small values.

In the solid scanning method, vertical stripes in a resulting image are problematic. With regard to vertical stripes occurring according to cycles of arrangement of the imaging component array, it is possible to prevent them from being remarkable by making the cycles of the arrangement of the imaging component array be different from those of the frequency band which is sensed by human being most sensitively.

This frequency band is known to be equal to or lower than 1 cycle per millimeter. Accordingly, it is possible to prevent vertical stripes in resulting images from being remarkable by making the arranging pitch of the imaging components be equal to or smaller than 1 mm.

Further, by making the arranging pitch of the imaging components be equal to or smaller than 1 mm, it is possible to reduce degradation of the imaging performance in comparison to imaging component arrays in the related art in which the arranging pitch is several millimeters through ten and several millimeters.

Figure 6:
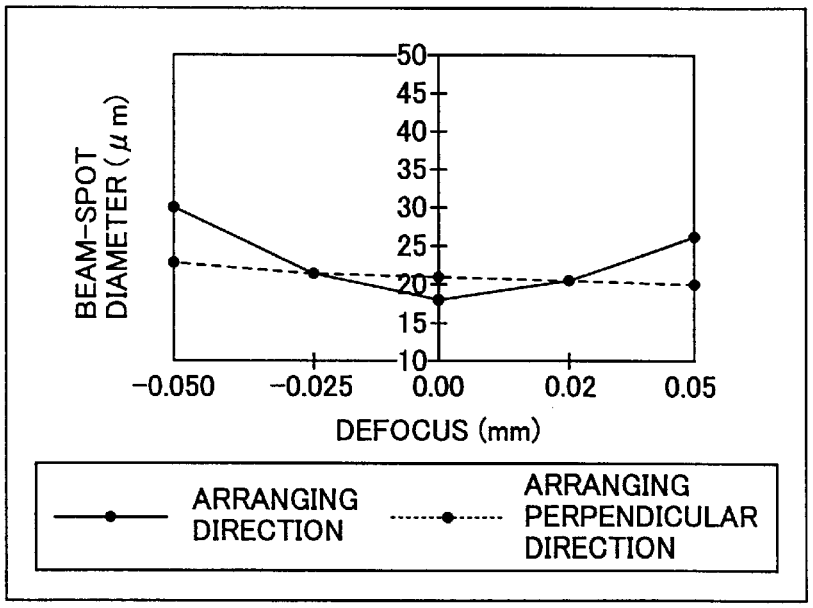
FIG. 6 shows a depth curve of beam-spot diameter (diameter of beam spot) in the first embodiment of the present invention.
Figure 7:
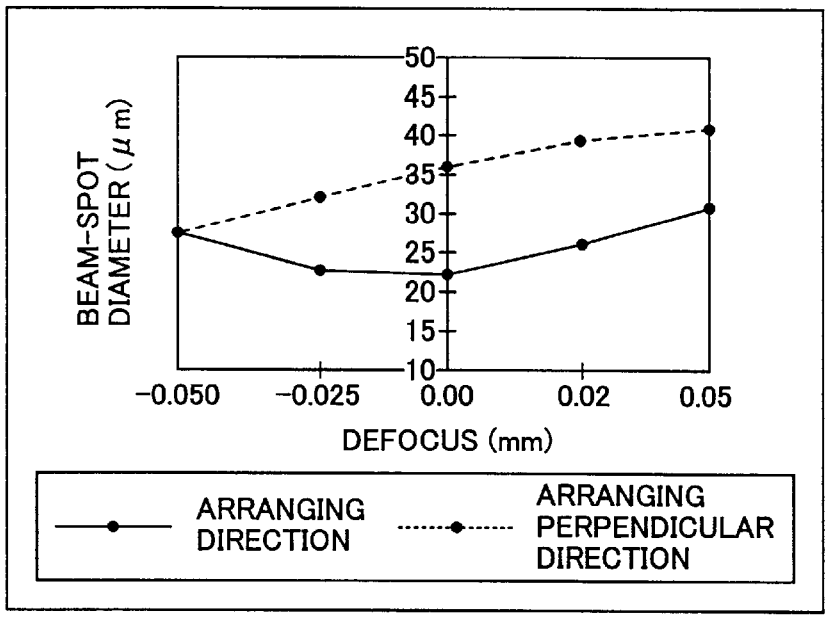
FIG. 7 shows a depth curve of beam-spot diameter in a comparison example to the first embodiment.

Then, FIG. 6 shows a result of simulation of diameter of beam spot ($1/e^2$ diameter) with respect to defocus in the first embodiment in a case where it is assumed that the above-mentioned light-emitting component array 1 is an LED array light source of 1200 dpi and is a completely diffusion light source having a size of 10 $\mu$m. Further, FIG. 7 shows a result of simulation of diameter beam spot ($1/e^2$ diameter) with respect to defocus in a comparison example (referred to as a comparison example 1, hereinafter) to the first embodiment in which, in the configuration relationship between the light-emitting component array 1, imaging component array and image carrying body surface of the image carrying body 3, the focal length of the imaging component array satisfies the unity-magnification relationship. It is noted that the imaging component array is such that the imaging components are arranged at the pitch of 0.7 mm, and an aperture having a width in the arranging direction of 0.6 mm and a width in the arranging perpendicular direction of 0.8 mm is disposed immediately in front of each of the entrance surface and exit surface of each imaging component.

As shown in FIG. 7, in the depth curve in the arranging perpendicular direction of the comparison example 1, it is seen that the position of the beam waist largely shifts to the minus side. Further, when it is assumed that an allowance of focal depth to be ±0.05 mm, the change amount of beam-spot diameter is 13 $\mu$m, and, thus, the change is large.

In contrast to this, in the case of the first embodiment, as shown in FIG. 6, it is seen that the diameter of beam spot is approximately uniform within the range of the allowance of focal depth, and the position of the beam waist is on or in the proximity of the image carrying surface. Further, when it is assumed that the allowance of focal depth to be ±0.05 mm, the change amount of beam-spot diameter is 3 $\mu$m, and, thus, the change is very small in comparison to the comparison example 1.

Further, in the arranging direction, in each of the first embodiment and comparison example 1, the position of the beam waist is located on or in the proximity of the image carrying surface, and a satisfactory diameter of beam spot is obtained. However, a smaller beam spot is obtained in the first embodiment.

Figure 8:
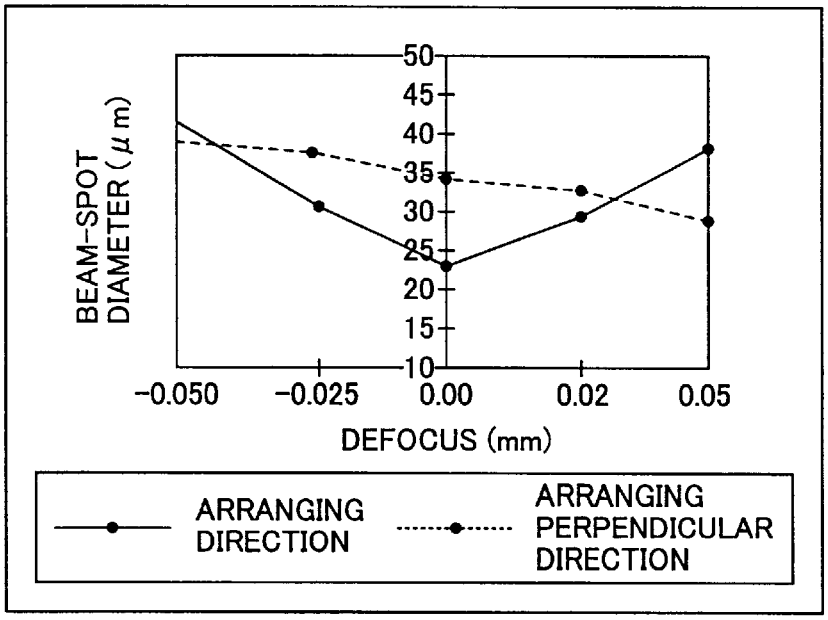
FIG. 8 shows a depth curve of beam-spot diameter in another comparison example to the first embodiment.

Here, when the upper limit is exceeded in the inequality (2), the position of the beam waist in the arranging perpendicular direction shifts to the plus side as shown in FIG. 8, and the change amount of the diameter of beam spot within the range of allowance of focal depth becomes larger.

FIG. 8 shows a result of simulation of diameter of beam spot ($1/e^2$ diameter) in a case, as a comparison example to the first embodiment, where f/f'=1.028 (>1.025).

The optical data of this case is shown below:

N=1.525;

L1=L2=6.0 (mm);

D1=D2=1.2 (mm);

R1'=3.25553 mm;

R2'=−3.25553 mm.

Further, the focal length f of the imaging components is such that f=3.5511 (mm) obtained using the equation (1).

Further, the ratio of the absolute values of the radiuses of curvatures is such that R/R'=1.034 (>1.03), and thus, does not satisfy the inequality (3).

Further, when the lower limit of the inequality (2) is exceeded, the position of the beam waist in the arranging perpendicular direction shifts to the minus side, and the change amount of the beam-spot diameter within the range of allowance of depth becomes larger.

Accordingly, as a result of the inequality (2) being made to be satisfied, it is possible to locate the position of the beam waist in the arranging perpendicular direction on or in proximity of the image carrying surface, and to enlarge the allowance of focal depth.

Figure 9:
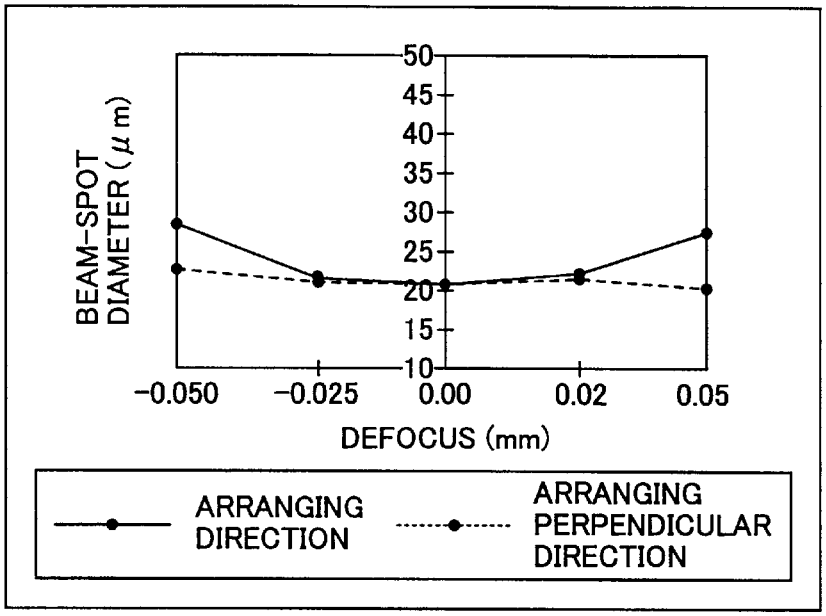
FIG. 9 shows a depth curve of beam-spot diameter in the second embodiment of the present invention.
Figure 10:
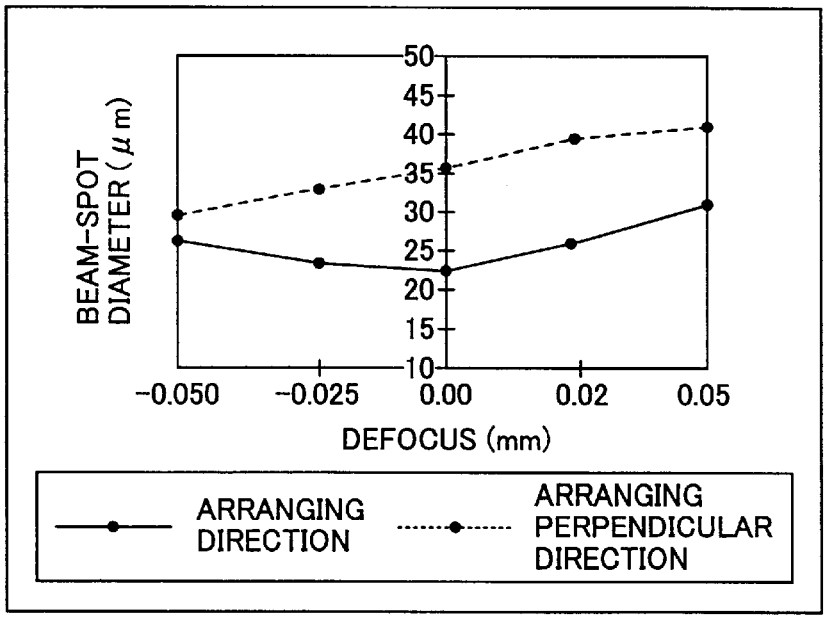
FIG. 10 shows a depth curve of beam-spot diameter in a comparison example to the second embodiment.

Then, FIG. 9 shows a result of simulation of diameter of beam spot ($1/e^2$ diameter) with respect to defocus in the second embodiment in a case where it is assumed that the above-mentioned light-emitting component array 1 is an LED array light source of 1200 dpi and is a completely diffusion light source having a size of 10 $\mu$m. Further, FIG. 10 shows a result of simulation of diameter of beam spot ($1/e^2$ diameter) with respect to defocus in a comparison example (referred to as a comparison example 2, hereinafter) to the second embodiment in which, in the configuration relationship between the light-emitting component array 1, imaging component array and image carrying body surface of the image carrying body 3, the focal length of the imaging component array satisfies the unity-magnification relationship. It is noted that the imaging component array is such that the imaging components are arranged at the pitch of 0.6 mm, and an aperture having a width in the arranging direction of 0.5 mm and a width in the arranging perpendicular direction of 0.6 mm is disposed immediately in front of each of the entrance surface and exit surface of each imaging component.

As shown in FIG. 10, in the depth curve in the arranging perpendicular direction of the comparison example 2, it is seen that the position of the beam waist largely shifts to the minus side. Further, when it is assumed that the allowance of focal depth to be ±0.05 mm, the change amount of diameter of beam spot is 7 μm, and, thus, the change is large.

In contrast to this, in the case of the second embodiment, as shown in FIG. 9, it is seen that the diameter of beam spot is approximately uniform within the range of the allowance of focal depth, and the position of the beam waist is on or in the proximity of the image carrying surface. Further, when it is assumed that the allowance of focal depth to be ±0.05 mm, the change amount of diameter of beam spot is 2 μm, and, thus, the change is very small in comparison to the comparison example 2.

Further, in the arranging direction, in each of the second embodiment and comparison example 2, the position of the beam waist is located on or in the proximity of the image carrying surface, and a satisfactory diameter of beam spot is obtained. However, a smaller beam spot is obtained in the second embodiment.

When the comparison example 1 and comparison example 2 are compared with one another, it is seen that the change of diameter of beam spot with respect to defocus in the arranging perpendicular direction is larger in the comparison example 1 shown in FIG. 7 than in the comparison example 2 shown in FIG. 10.

This results from difference in size of aperture diameter in the arranging perpendicular direction. As the ratio of the aperture diameter in the arranging perpendicular direction to the aperture diameter in the arranging direction becomes larger, the change in diameter of beam spot with respect to defocus in the arranging perpendicular direction becomes larger.

Accordingly, as the ratio of the aperture diameter in the arranging perpendicular direction to the aperture diameter in the arranging direction is larger than 1, the present invention becomes more effective.

Further, by enlarging the aperture diameter in the arranging perpendicular direction, it is possible to provide a brighter imaging optical system. Thereby, because a light output from the optical printing head increases, it is possible to increase the printing speed of an image forming apparatus employing the optical printing head as an exposure unit thereof.

Further, as a result of the light output from the optical printing head being increased, it is possible to reduce the light-emitting output of the light-emitting component array, and, thereby, to save the energy.

Figure 11:
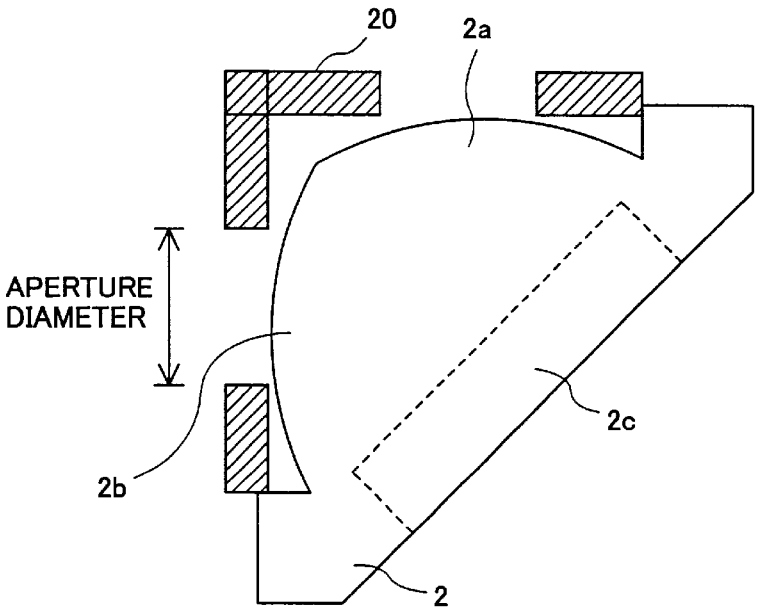
FIG. 11 shows a section of an example of an aperture member employed in the imaging component array in each of the first and second embodiments of the present invention.
Figure 12:
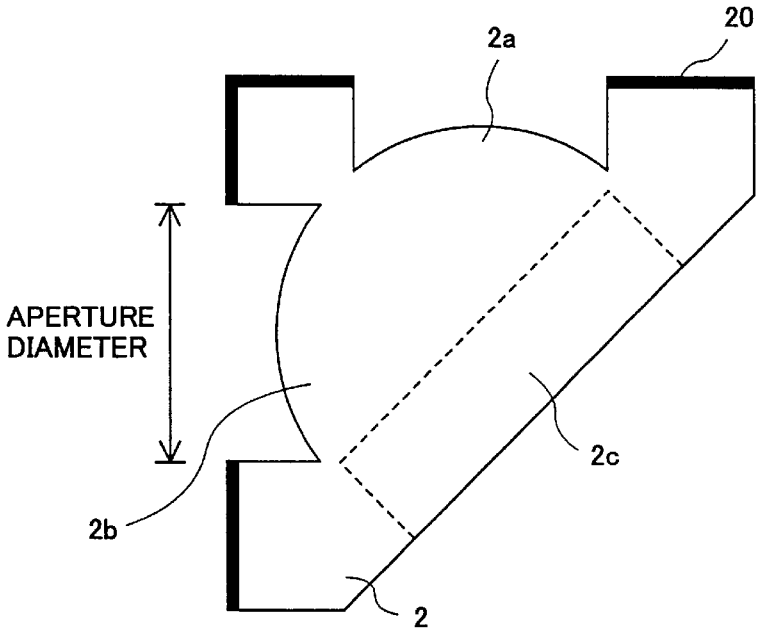
FIG. 12 shows a section of another example of an aperture member employed in the imaging component array in each of the first and second embodiments of the present invention.

The above-mentioned aperture diameters are a size of an effective area for a light flux to be transmitted/reflected through the entrance surface and exit surface of the imaging component. As shown in FIG. 11, it is possible to employ an aperture member 20 having apertures smaller than the outline of the entrance surface 2*a* and exit surface 2*b* of each imaging component of the roof prism lens array 2, or, as shown in FIG. 12, to employ an aperture member 20 on ribs of each imaging component of the roof prism lens array 2. Thus, it is possible to set appropriate ones of the aperture diameters.

Further, the optical printing head including of the above-mentioned light-emitting component array and imaging component array can be used as an exposure unit of an image forming apparatus.

Figure 13:
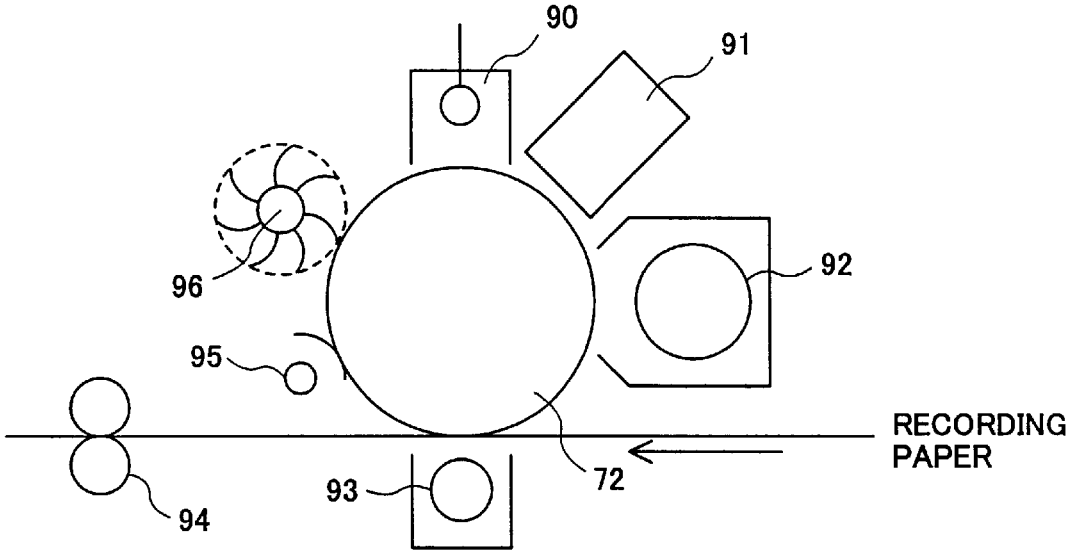
FIG. 13 simply shows an image forming apparatus in which the optical printing head in each of the first and second embodiments of the present invention may be employed as an exposure unit.

FIG. 13 shows an image forming apertures. As shown in the figure, around an image carrying body 72, a charging unit 90, an exposure unit 91 which is the optical printing head including the light-emitting component array and imaging component array, a developing unit 92, a transfer unit 93, a fixing unit 94, a charge-removal unit 95, a cleaner unit 96 and so forth are disposed.

As well-known, in an electrophotography process, a latent image is formed on the image carrying body 72 as a result of beam spots formed by the optical printing head being formed onto the image carrying body 72 (exposure), a toner image is formed from the latent image as a result of tone being made to adhere to the latent image (development), the toner image is transferred to a recording paper sheet (transfer), and the toner image is then fixed onto the recording paper sheet by pressure and heat (fixing). Thus, a printed image is formed.

Figure 4:
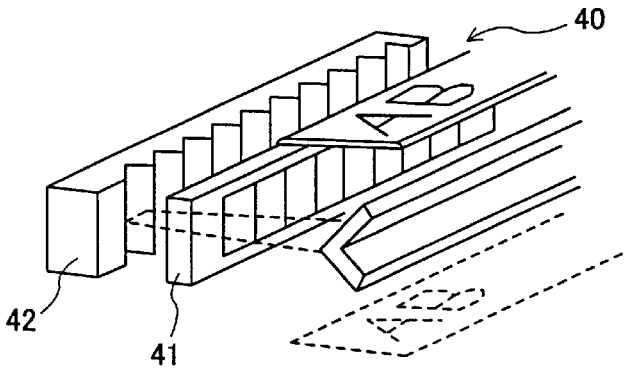
FIG. 4 shows a perspective view of a roof mirror lens array which may be used in an optical printing head according to the present invention as an imaging component array.

The above-mentioned imaging component array is not necessary to be limited to the roof prism lens array 2, and, therefor, it is also possible to use a roof mirror lens array 40, shown in FIG. 4, forming an erecting system in the array arranging direction.

This roof mirror lens array 40 includes a lens array 41 having a plurality of lenses arranged therein each having an entrance surface and an exit surface, and a roof mirror array 42 having a plurality of roof mirrors arranged therein each having a pair of reflective surfaces in right angles to one another.

Figure 5:
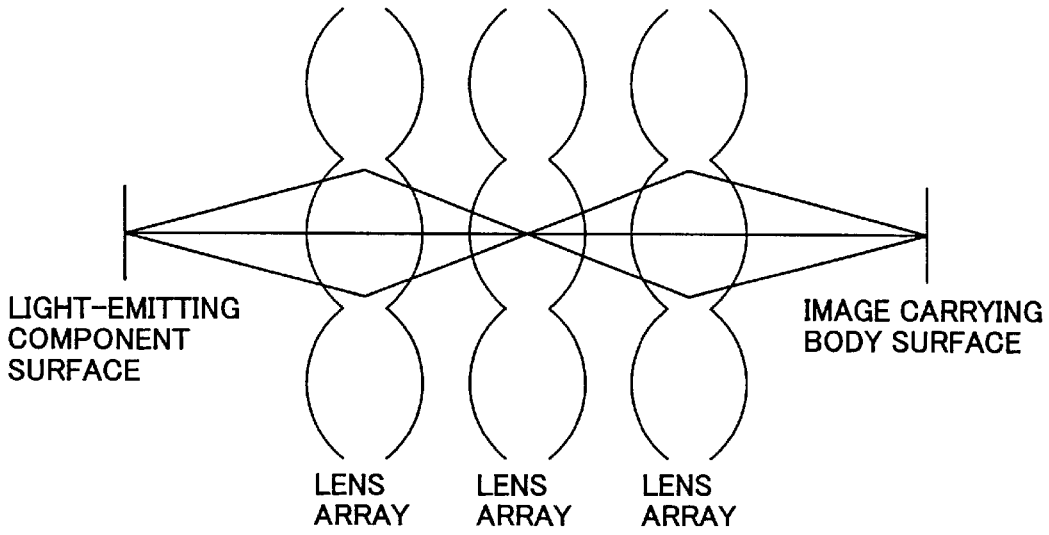
FIG. 5 simply shows a lens array which may be used in an optical printing head according to the present invention as an imaging component array.

Further, for the same purpose, as shown in FIG. 5, it is also possible to use a lens array having a combination of a plurality of lens arrays each forming an erecting system in the array arranging direction.

The present invention is not limited to the above-described embodiments, and variations and modifications may be made without departing from the scope of the present invention.

The present application is based on Japanese priority application No. 11-334329, filed on Nov. 25, 1999, the entire contents of which are hereby incorporated by reference.

What is claimed is:

1. An optical printing head comprising:

a light-emitting component array having a plurality of light-emitting components arranged therein; and an imaging component array having a plurality of imaging components arranged therein each for imaging from a light flux from a respective light-emitting component of said light-emitting component array to a beam spot on an image carrying body surface, wherein, in a configuration relationship between said light-emitting component array, imaging component array and image carrying body surface, a focal length of said imaging components is slightly larger than a focal length of the imaging components obtained in a condition in which a unity-magnification relationship is satisfied, wherein the imaging component array forms an image erecting system along an arranging direction along which the plurality of imaging components are arranged, and the light flux from each light-emitting component forms an image on the image carrying body through a plurality of imaging components of the imaging component array.

2. The optical printing head as claimed in claim 1, wherein:

$$1.005 \leqq f/f' \leqq 1.025$$

where:

f denotes the focal length of said imaging components; and f' denotes the focal length of the imaging components obtained in the condition in which the unity-magnification relationship is satisfied.

3. The optical printing head as claimed in claim 1, wherein:

the focal length is made slightly longer as a result of radiuses of curvatures of surfaces having power of said imaging components being changed from radiuses of curvatures of surfaces having power of the imaging components obtained in the condition in which the unity-magnification relationship is satisfied.

4. The optical printing head as claimed in claim 1, wherein an arranging pitch of said imaging component array is equal to or shorter than 1 mm.

5. The optical printing head as claimed in claim 1, wherein said imaging component array comprises a roof prism lens array in which entrance surfaces are equal to exit surfaces in radius of curvature in absolute value.

6. The optical printing head as claimed in claim 5, wherein:

$$1.005 \leqq R/R' \leqq 1.03,$$

where:

R denotes the absolute value of the radiuses of curvatures of the entrance surfaces and exit surfaces of said imaging component array; and R' denotes an absolute value of radiuses of curvatures of entrance surfaces and exit surfaces of the imaging component array obtained in the condition in which the unity-magnification relationship is satisfied.

7. The optical printing head as claimed in claim 6, wherein a ratio of an aperture diameter in an arranging perpendicular direction to an aperture diameter in an arranging direction is larger than 1.

8. An image forming apparatus employing the optical printing head as claimed in claim 1 as an exposure unit.

9. An image forming apparatus employing the optical printing head as claimed in claim 2 as an exposure unit.

10. An image forming apparatus employing the optical printing head as claimed in claim 3 as an exposure unit.

11. An image forming apparatus employing the optical printing head as claimed in claim 4 as an exposure unit.

12. An image forming apparatus employing the optical printing head as claimed in claim 5 as an exposure unit.

13. An image forming apparatus employing the optical printing head as claimed in claim 6 as an exposure unit.

14. An image forming apparatus employing the optical printing head as claimed in claim 7 as an exposure unit.

* * * * *